United States Patent [19]

Gilbride

[11] 4,280,242

[45] Jul. 28, 1981

[54] SEGMENTED LASTING WIPER

[75] Inventor: Andrew J. Gilbride, Swampscott, Mass.

[73] Assignee: USM Corporation, Farmington, Conn.

[21] Appl. No.: 35,895

[22] Filed: May 3, 1979

[51] Int. Cl.[3] ..... A43D 21/00

[52] U.S. Cl. ..... 12/12.4; 12/145

[58] Field of Search ..... 12/12, 12.4, 12.5, 145

[56] References Cited

U.S. PATENT DOCUMENTS

| | | | |
|---|---|---|---|
| 3,032,791 | 5/1962 | Vlcek | 12/12.4 |
| 3,105,983 | 10/1963 | Deschenes et al. | 12/12 |
| 3,258,799 | 7/1966 | Weinschenk | 12/12 |

*Primary Examiner*—Patrick D. Lawson

*Attorney, Agent, or Firm*—Donald N. Halgren

[57] ABSTRACT

A machine for pulling and lasting a shoe upper has a lasting wiper comprised of adjustable segments, to permit one set of wipers to last a complete range of shoe sizes and shapes. The wiper segments are all adjustable about a common pivot point, and are held secure with respect to one another and to a common carrier. Each wiper segment is of arcuate configuration, which locks with its adjacent wiper segment, as well as at both transverse ends thereof with the carrier.

3 Claims, 2 Drawing Figures

SEGMENTED LASTING WIPER

BACKGROUND OF THE INVENTION

1. Field of the Invention

This invention relates to shoe upper forming machines, and more particularly, to adjustable wiper mechanisms for performing lasting on the forepart region of a shoe being lasted therewith.

2. Prior Art

In the manufacture of a shoe, a leather upper is placed on a last, and an insole is also secured to the last. The last is suitably arranged in a lasting machine where the upper is pulled tightly over the last after cement has been applied around the periphery of the insole. A pair of wipers slidably arranged on the lasting machine may then be caused to move towards the toe of the last to wipe the edge of the upper over the periphery of the insole. The inward wiping of the upper is a significant element in the manufacture of a shoe. It is important that wipers adapted to engage the forepart region of a shoe upper be properly oriented to effect simultaneous wiping thereof at all points along both sides of the forepart of that shoe. The wipers should conform generally to the shape of the last around the entire forepart of the shoe and be moved inwardly over the shoe bottom substantially at right angles to the edge of the insole. However, conventional wipers for a given shoe style are profiled to a compromise forepart or toe shape based on the midsize shoe selected from an entire run of sizes, and in most cases, the one set of wipers is used to wipe the entire run of sizes. When the toe shapes are assymetrical, usually individualized left and right wipers are required for wiping in the lasting machine. The expense of manufacturing, storage, setup and maintenance of all these types of wipers is burdensome. The wiper arrangements themselves can become involved, as exemplified by U.S. Pat. Nos. 3,196,470 and 3,222,703.

It is an object of the present invention to provide single wiper pair arrangement adaptable to existing shoe lasting machines, where the wipers are capable of wiping any size or shape forepart of any shoe with minimum time and expense consumed with regard thereto.

BRIEF SUMMARY OF THE INVENTION

A machine for pulling and lasting a shoe upper about a last is provided with a wiper arrangement comprising a plurality of adjustable segments which permits the proper wiping of any size or shape toe of a shoe being lasted therewith. Each wiper segment is of arcuate configuration and is in an interlocking relationship with its adjacent segmented wipers. The segmented wipers are supported between carrier plates which are themselves pivotally supported between a pair of support plates. Each wiper segment has an expandable locking mechanism to secure the segments with respect to one another and to secure the carrier plate therewith. The locking mechanisms and arcuate contour of the segments permits simple readjustment of the segments within the carrier plates, to adapt to any size or profile of shoe being lasted.

BRIEF DESCRIPTION OF THE DRAWINGS

The objects and advantages of the aforementioned invention will become more apparent when viewed in conjunction with the following drawings, in which.

DESCRIPTION OF THE PREFERRED EMBODIMENT

Figure 1:
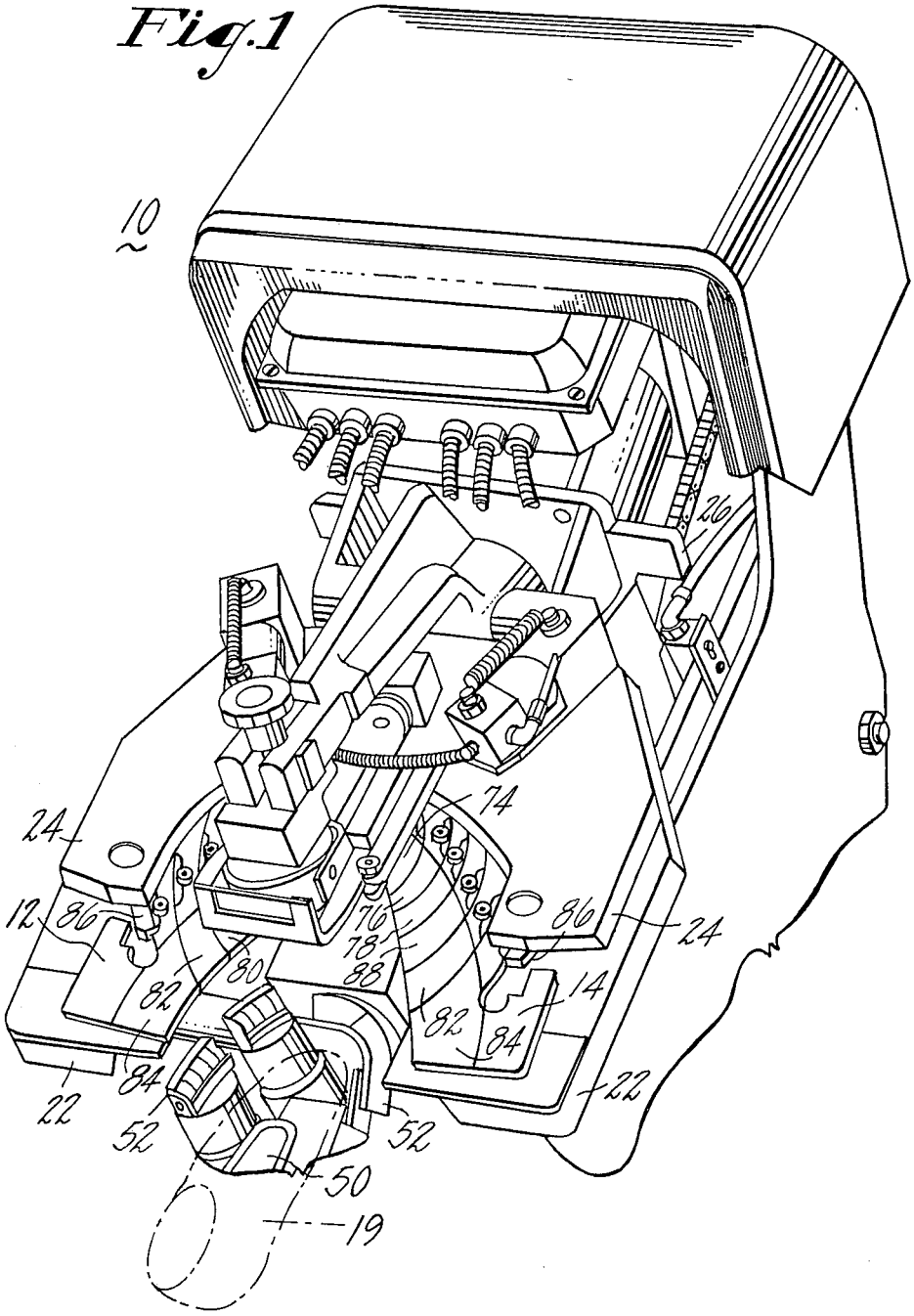
FIG. 1 is a partial perspective view of a shoe machine utilizing a segmented wiper arrangement constructed according to the principles of the present invention.

Referring to the drawings in detail, and particularly to FIG. 1, there is shown a shoe upper conforming machine 10, suitable for use in pulling and lasting a shoe upper in the toe and ball regions and the forepart of a shoe.

Figure 2:
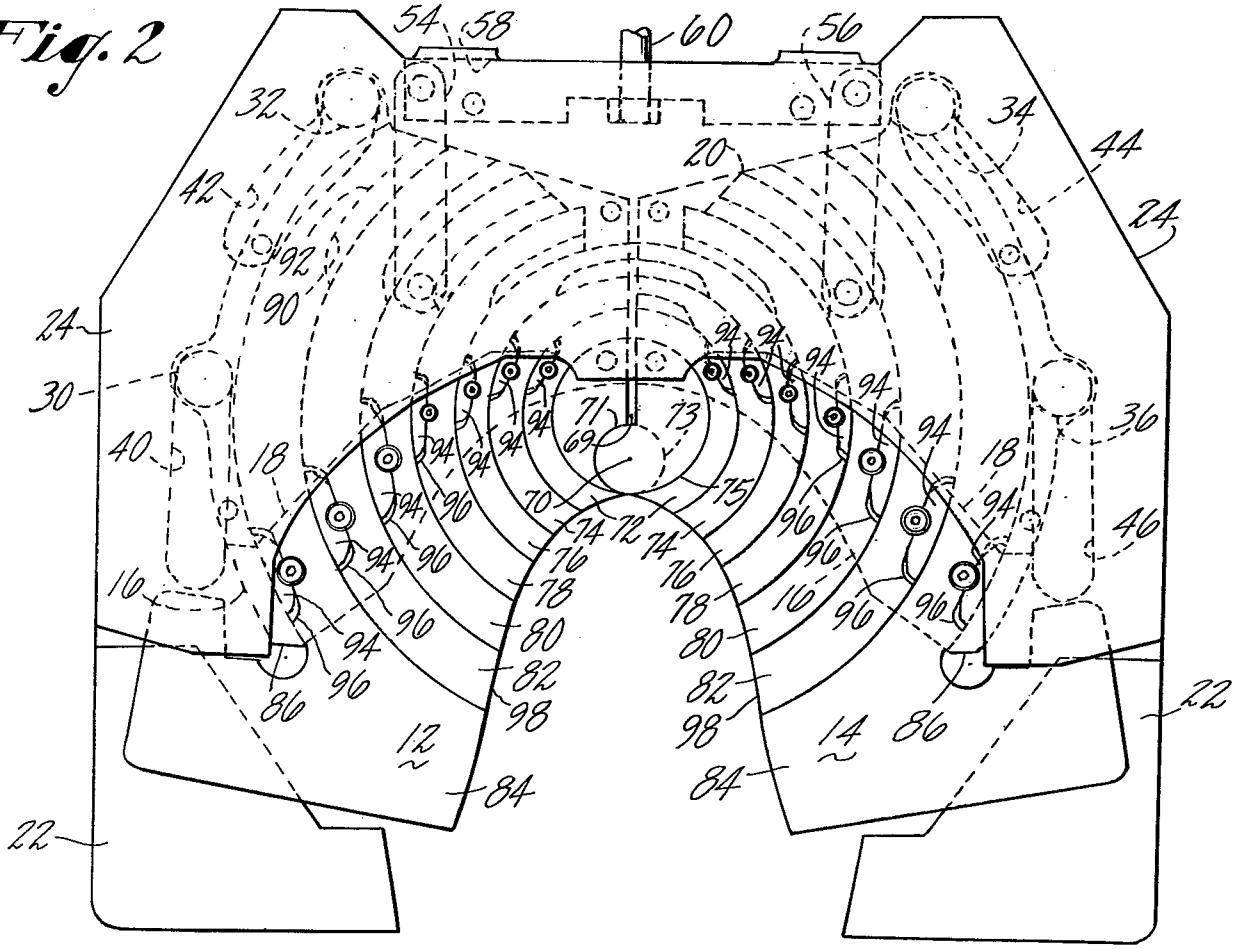
FIG. 2 is a plan view of the segmented wiper arrangement.

A pair of wipers 12 and 14, are sandwiched between a lower carrier plate 16 and an upper carrier plate 18, shown in dashed lines in FIG. 2, and comprise a wiper head 20 which is movably arranged between a lower support plate 22 and an upper cam plate 24. The lower support plate 22 and the upper cam plate 24 are fixedly attached to a frame portion 26 of the machine 10. The upper carrier plate 18 is provided with an arrangement of cam rolls 30, 32, 34 and 36, as shown in FIG. 2, and are mounted on pins, not shown, which extend upwardly from the upper carrier plate 18. The cam rolls 30, 32, 34 and 36, are received in an arrangement of cam slots 40, 42, 44 and 46, disposed in the underside of the upper cam plate 24, to provide guidance to the carrier plates, 16 and 18, and their respective segmented wipers 12 and 14, in their advancing, closing and withdrawing movements in regard to a shoe upper and last 19, shown only in outline form by dashed lines, which will comprise the outline of the shoe being lasted. The shoe upper and last may be supported by a last insole support plate 50, and the upper is tightenable therewith by an arrangement of movable grippers 52 which are known in the art. The carrier plates 16 and 18 are connected, through a pair of pivotable links 54 and 56, to a cross-bar 58. The cross-bar 58 is attached to the lower end of a reciprocably movable piston rod 60. The piston rod 60 is attached to a pressurizable piston, not shown, when activated through proper means, causes the reciprocating motion in the piston rod, cross-bar 58 and the segmented wipers 12 and 14, to effectuate the proper curvilinear wiping and withdrawing motion therein.

The segmented wipers 12 and 14, pivot about a pivot axis 69, and the carrier plates 16 and 18, rotate about a pivot axis 70. The pivot axis 70 is comprised of overlapping circular portions 71 and 73, which also comprises a radially inner support flange 75 on the lower carrier plates 16. Each segmented wiper 12 or 14, may be comprised of a plurality of generally "C" shaped or curvilinear segments 72, 74, 76, 78, 80 and 82, as well as an outer wiper segment 84. Each wiper segment, 72 through 84, is adjustably arrangeable along the upper surface of the lower carrier plate 16. A curvilinear upstanding flange 86 is arranged along the radially outermost periphery of each of the lower carrier plates 16 to provide radially outermost transverse support to the wiper segments 72 through 84. The flange 86 also provides means for securing the upper carrier plate 18, to the lower carrier plate 16, through a plurality of bolts extending therebetween.

Each wiper segment 72 through 84, may have a groove 90 along at least the proximal portion of its inner curvilinear periphery, and its adjacent wiper segment may have a tongue 92 in a mating relationship with at least a part of the groove 90 in the neighboring segment.

The wiper segments 72, 74, 76, 78, 80, 82 and 84, may be interlocked with their adjacent wiper segments and the flange 86 on the lower carrier plate 16, by a plurality of expanding locks 94 one each in a cutout 96 on the outer periphery of each segment, to expand against, tighten and fixedly secure each wiper segment 72, 74, 76, 78, 80, 82 and 84 against its neighbors as well as the outer flange 86 and the inner flange 75 of each of the lower carrier plates 16.

A pre-operational adjustment of the aforementioned machine 10, may be accomplished, wherein a last and upper 19, or a template which would represent a shoe bottom, not shown, may be placed on the insole support plate 50, and the upper tensioned by the grippers 52. The wiper head 20 may then be advanced, to a pre-wipe position with the wiper segments loosely supported thereon to their extended most position, until they contact the margin of the shoe or template being lasted. The wiper segments, 72 through 84 may then be permitted to "find" their proper location by interaction with respect to the outer margin of the shoe 19, or template, as well as the support plates 16 and 18, and one another. Each lock 94 may then be tightened, and the upper head 20 withdrawn, to a start position for full operational use thereof.

The wiper segments 72 through 84 are thus locked against one another to permit their distal ends to define an adjustably arrangable profile 98 which will properly match and permit in-wiping of any particular shape or size shoe being lasted. The profile 98 may have step-like features due to the relationship of adjacent segments with respect to one another, which steplike features however are not detrimental to the wiping function.

Thus, there has been described, a wiper arrangement comprising a plurality of interlocking curvilinear segments which may be adjusted on and in regard to its holding means, to permit the distal ends of those segments to conform to a variety of shoe bottom styles, sizes and shapes, thus eliminating the need and expense of maintaining a large inventory of wiper plates for each particular style and size shoe to be lasted by a shoe manufacturer.

It is intended that the foregoing invention be interpreted herein as exemplary only, and not in a limiting sense.

I claim:

1. A wiper arrangement for a shoe lasting machine for lasting a variety of sizes and styles of shoes therewith, including:

a frame in said machine for supporting said wiper arrangement thereon;

said wiper arrangement comprising:

a pair of wipers each mounted in a movable wiper carrier;

each wiper being adjustably arrangable with respect to its carrier to define any required contour, permitting said wiper to last a variety of shoe sizes and shapes;

each of said wipers being comprised of a plurality of arcuate segments, each segment being adjustable with respect to one another and to said carrier, to provide said contour which is defined by the distal ends of said segments.

2. A wiper arrangement for a shoe lasting machine for lasting a variety of sizes and styles of shoes as recited in claim 1, wherein each segment is lockable in any position with respect to its adjacent segments, and said segments are collectively lockable with respect to said carrier.

3. A wiper arrangement for a shoe lasting machine for lasting a variety of sizes and styles of shoes as recited in claim 1, wherein at least the proximal ends of said segments having a mating interrelationship with the proximal ends of any segments thereadjacent.

* * * * *